US006520790B2

(12) United States Patent
Okamoto

(10) Patent No.: US 6,520,790 B2
(45) Date of Patent: Feb. 18, 2003

(54) WATERPROOFING CONFIGURATION FOR A LIGHTING FIXTURE

(75) Inventor: Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/901,099

(22) Filed: Jul. 10, 2001

(65) Prior Publication Data

US 2002/0019158 A1 Feb. 14, 2002

(30) Foreign Application Priority Data

Jul. 11, 2000 (JP) ..... 2000-210523

(51) Int. Cl.[7] ..... H01R 4/50
(52) U.S. Cl. ..... 439/336
(58) Field of Search ..... 439/336, 362, 439/584, 318, 602, 279, 298, 356, 357, 672, 559, 918, 611–619, 271–273, 556, 654; 362/431, 426, 238, 249

(56) References Cited

U.S. PATENT DOCUMENTS 4,804,343 A * 2/1989 Reedy ..... 439/854
4,996,636 A * 2/1991 Lovett ..... 362/431
5,087,213 A * 2/1992 Drapcho et al. ..... 439/672
5,139,433 A * 8/1992 Bhaty ..... 439/395

FOREIGN PATENT DOCUMENTS

| | | |
|---|---|---|
| FR | 2700074 | 7/1994 |
| GB | 2187048 | 8/1987 |
| JP | 4-51784 | 4/1992 |

* cited by examiner

*Primary Examiner*—Lynn D. Feild
*Assistant Examiner*—J. F. Duverne
(74) *Attorney, Agent, or Firm*—Banner & Witcoff, Ltd.

(57) ABSTRACT

The invention improves the assembly operation of a lighting fixture. A single electric wire W is distributed between a connector 3 and bulb sockets 1 and 2, and contact welding terminals 11A and 11B attached to the connector 3 and the bulb sockets 1 and 2 make contact. The electric wire W is cut off at specified locations, thereby forming a feeder circuit to bulbs B. Next, a sealing member 22 made from elastomer is moulded so as to cover portions of the electric wire W extending from the connector 3 and the bulb sockets 1 and 2, then the bulb sockets 1 and 2 and the connector 3 are inserted into attachment holes 8 passing through a lighting fixture panel 7.

17 Claims, 8 Drawing Sheets

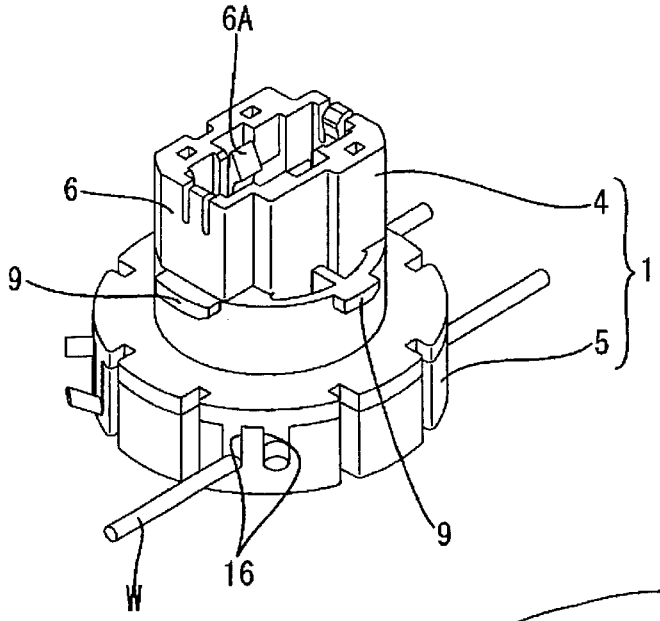
Fig 4
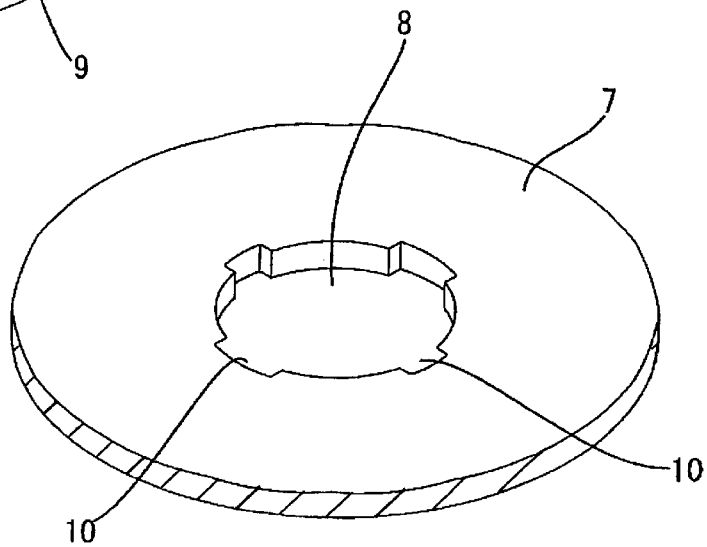
Fig 5A
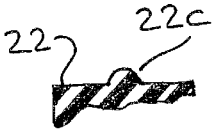
Fig 5B
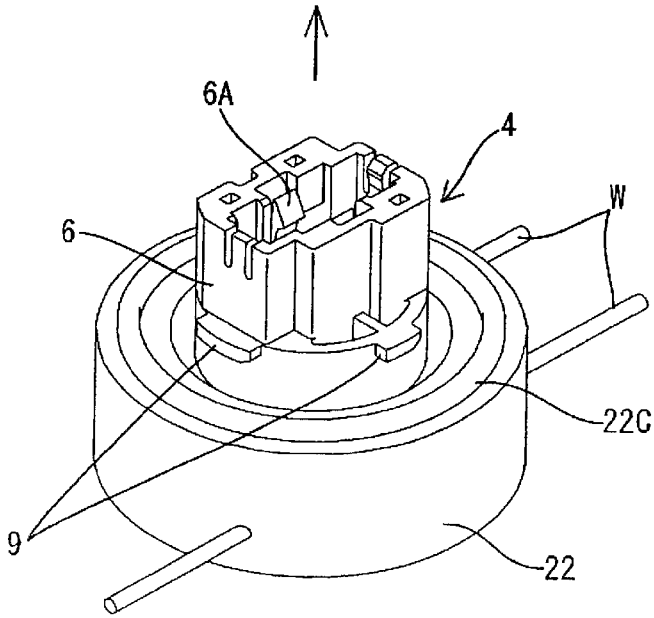

WATERPROOFING CONFIGURATION FOR A LIGHTING FIXTURE

TECHNICAL FIELD

The present invention relates to a waterproofing configuration for a lighting fixture.

BACKGROUND TO THE INVENTION

Conventionally, some lighting fixtures used in motor vehicles constitute units having a plurality of bulbs. In these cases, electric wires form a circuit between the bulbs to allow the bulbs of the unit to be lit simultaneously. In the case where the lighting fixture needs to be waterproofed, each bulb socket housing a bulb must be provided with a separate waterproofing configuration.

One example of a waterproofing configuration for a lighting fixture is described in JP-4-51784. In this example, as shown in FIG. 11 of this specification, a sealing ring 31 is fitted to an outer circumference face of a bulb socket 30 which houses a bulb B. The sealing ring 31 is squeezed against a panel 32 when the bulb socket 30 is attached to this panel 32, thereby forming a seal between the bulb socket 30 and the panel 32. A plurality of terminal fittings 33, which provide electricity to each bulb B, are housed within the bulb socket 30. These terminal fittings 33 lead to the exterior and are connected to electric wires W. These electric wires are inserted collectively through a rubber stopper 34 fitted to the bulb socket 30, thereby providing a seal between the electric wires W and the bulb socket 30.

In the configuration described above, the electric wires W are first passed through the rubber stopper 34, and the terminal fittings 33 are then joined to these electric wires W by means of crimping. That is, the following operations are required: the electric wires W are passed through the rubber stopper 34, the terminal fittings 33 are crimped to the electric wires W, the terminal fittings 33 are attached to the bulb sockets 30, and the rubber stoppers 34 are pushed onto the bulb sockets 30. Consequently, many operations are required, and operability becomes a problem. This also presents an obstacle to automating these operations.

The present invention has taken the above problem into consideration, and aims to improve the operability of a waterproofing configuration for a lighting fixture.

SUMMARY OF THE INVENTION

According to a first aspect of the invention, there is provided a bulb socket assembly comprising a bulb socket having insulation displacement terminals, insulated electrical wires connected to said terminals by insulation displacement, and a sealing member moulded over said assembly so as to encapsulate said terminals, portions of said wires connected thereto, and portions of said socket.

Such an arrangement provides easy connection by pressure contact, and assured waterproofing by over moulding. In the preferred embodiment the sealing member extends over a bayonet fitting bulb socket so as to cover the usual stop flange, thereby providing a panel seal for the socket. Overmoulding also provides a convenient method of sealing adjacent cut edges of wire.

According to a second aspect, the invention provides a method of waterproofing a plurality of bulb socket assemblies, each having a bulb socket and an insulation displacement terminal electrically connected to a common insulated wire by insulation displacement, the method comprising moulding a sealing member over a portion of each socket so as to encapsulate respective terminals and portions of said wire connected thereto. This method ensures waterproofing of individual sockets, yet permits individual attachment of each socket to a mounting.

According to a third aspect, the invention provides a method of wiring a plurality of bulb sockets to an electrical connector, each socket having two insulation displacement terminals to be electrically connected to an insulated wire by insulation displacement, the method comprising the steps of using a single length of insulated wire to connect said connector to all of said terminals, cutting away portions of said wire to define separate electrical connections between said connector and sockets and moulding respective sealing member over portions of each socket so as to encapsulate respective terminals, portions of wires connected thereto and adjacent cut ends of said wires. This method does not require separate lengths of wire, and this assembly operation is facilitated whilst ensuring adequate sealing of cut-wire ends.

BRIEF DESCRIPTION OF DRAWINGS

Other features of the invention will be apparent from the following description of a preferred embodiment shown by way of example only in the accompanying drawings in which:

FIG. 4 is a diagonal view of the double-bulb bulb socket in an assembled state.

FIG. 5A is a diagonal view showing the state after the sealing member has been moulded.

FIG. 5B is a scrap section showing an upstanding circular seal.

A lighting fixture of the present embodiment is configured as a single unit having three bulbs of two differing types. FIG. 1 shows the wiring of the components of this unit, wherein bulbs B fit into one double bulb socket (i.e., a bulb having two filaments) and two single bulb sockets (i.e., each bulb having one filament). The bulbs B receive electricity by being connected to a connector 3 which connects the unit to an external power source. As shown in FIGS. 6 and 7, the bulbs B and the connector 3 are attached to attachment holes 8 which are formed in a lighting fixture panel 7.

Figure 1:
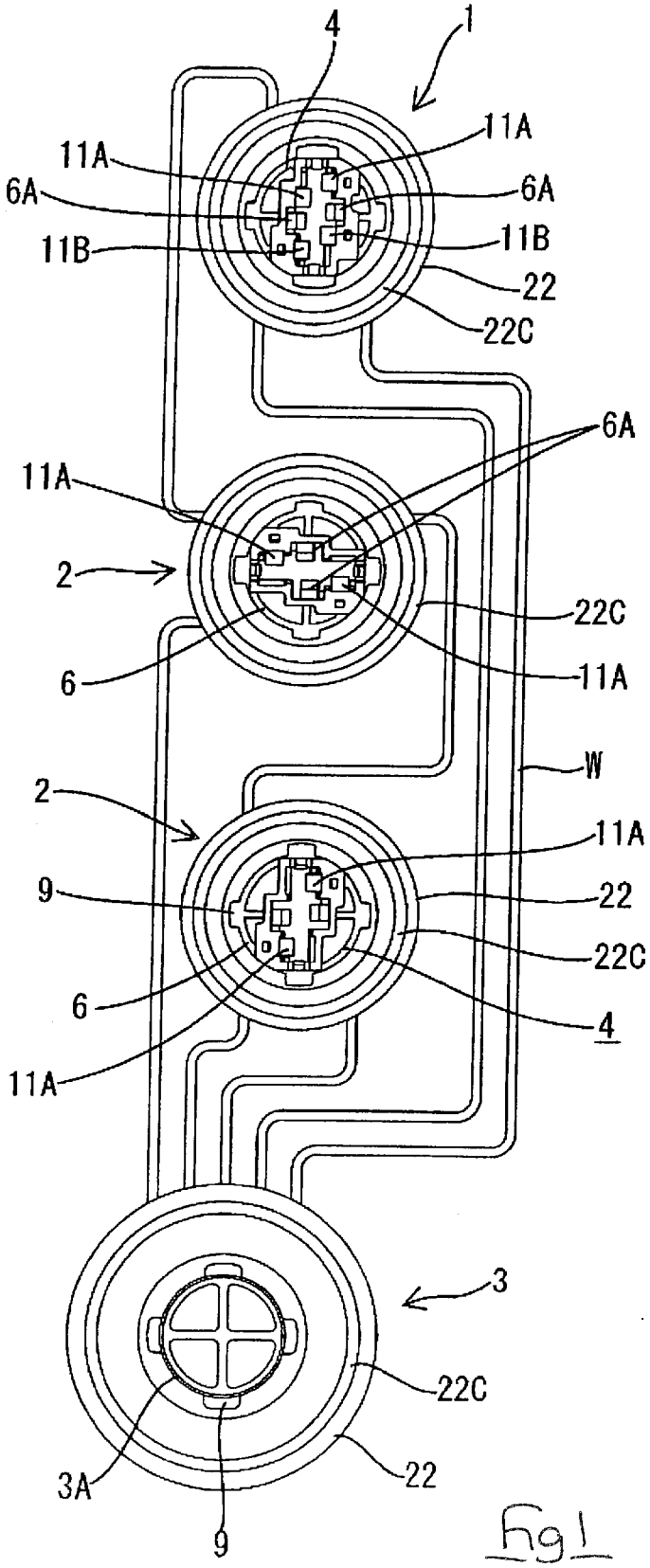
FIG. 1 is a plan view showing a wiring configuration between bulb sockets after a sealing member has been moulded.

First bulb sockets 1 and 2, which house the bulbs B, will be described. Each bulb socket 1 and 2 is composed of a socket main body 4 and a base member 5 (a socket base)

which are made from plastic and formed in a unified manner. The socket main body 4 is capable of housing the bulbs B. An electric wire W, attached to a lower face side of the socket main body 4, is distributed within the base member 5.

The socket main body 4 has a cylindrical bulb housing member 6 which is open above and below, this being capable of housing either a single or a double bulb. This bulb housing member 6 can be passed through the attachment hole 8 of the panel 7, and four bayonet members 9, which are mutually separated by approximately 90 degrees, protrude from an outer side face of the bulb housing member 6. These bayonet members 9 can be fitted into corresponding recesses 10 formed in the attachment hole 8 of the panel 7. After the bayonet members 9 have been fitted into these recesses 10, the entirety of the bulb socket 1 or 2 is rotated, thereby causing the bayonet members 9 to engage with hole edges of the attachment hole 8 and retaining the bulb socket 1 or 2 within the panel 7.

Figure 7:
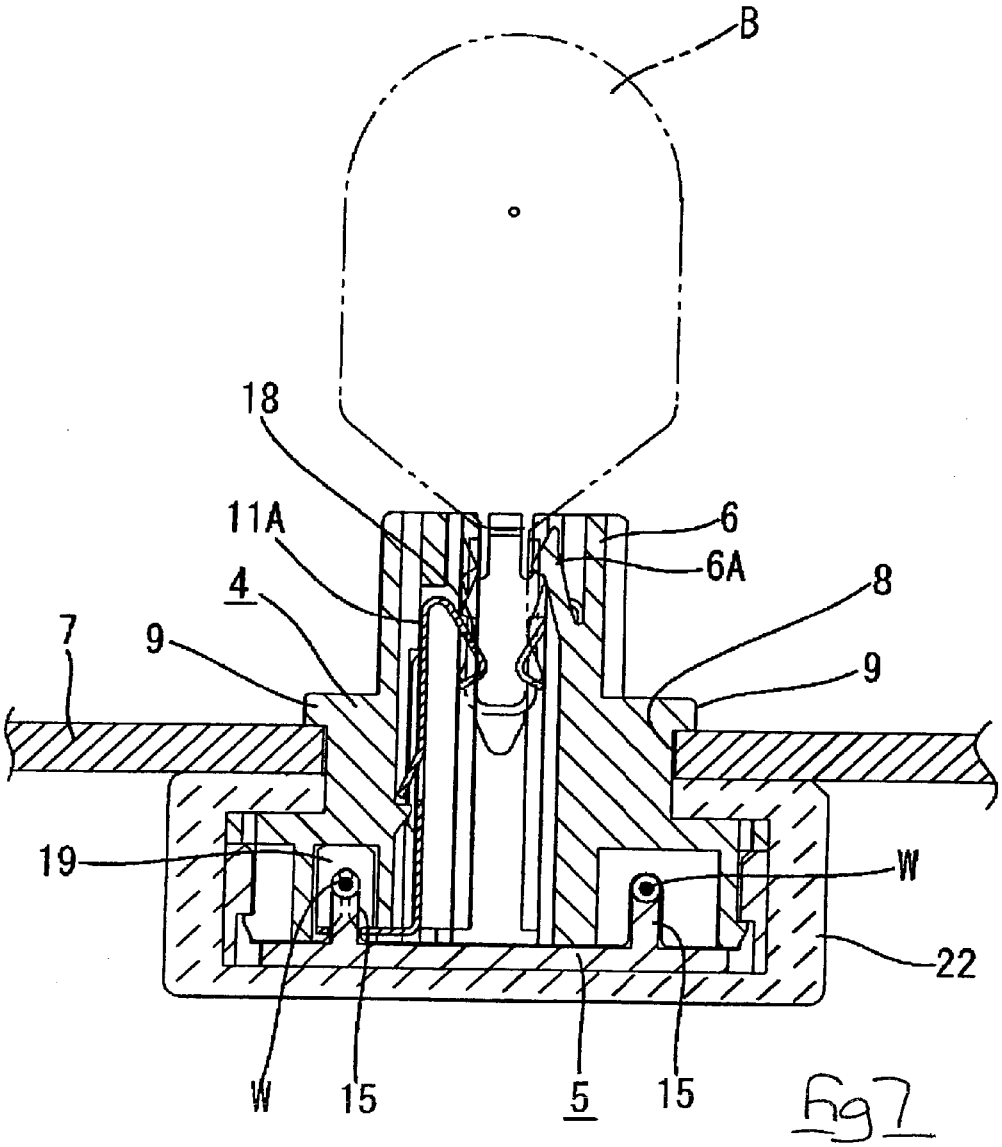
FIG. 7 is a cross-sectional view showing a bulb housed within the bulb socket.

A pair of bendable retaining arms 6A, for maintaining the bulb B in an unremovable state, are provided within the bulb housing member 6 (see FIG. 7). These retaining arms 6A are located towards the sides (relative to the widthwise direction of the bulb housing member 6) and grip the bulb B, thereby resiliently retaining this bulb B and preventing it from being removed. In addition, terminals 11A and 11B (for providing electricity to the bulb B) are attached to the interior of the bulb housing member 6, these being inserted from a base face side thereof, at locations outwards relative to the location of the retaining arms 6A. The number and type of terminals 11A and 11B can be varied according to the type of bulb B being housed. An upper end of each terminal 11A and 11B is bent over to form an angled spring-like contact member 18, these gripping the bulb B from both sides, relative to the widthwise direction thereof, and making resilient contact with contacts of the bulb B (these contacts are not shown in detail but are conventional lead wires extending from both sides of the bulb B, relative to the widthwise direction thereof). A lower end of each terminal 11A and 11B forms a contact member 19 which is composed from a pair of contacts 12 having grooves 13 therein. When the terminals 11A and 11B are attached within the bulb housing member 6, opening sides of the grooves 13 face a lower face side of the bulb housing member 6. Furthermore, pressing the electric wire W into the grooves 13 displaces the insulation of the electric wire W, core wires therein make contact with the grooves 13, allowing an electrical current to pass therethrough. The single-bulb bulb socket 2 has only the pair of mutually opposing terminals 11A attached thereto. The double-bulb bulb socket 1 is provided with both the terminals 11A and the terminals 11B, the pairs of contact members 18 thereof being joined by a joining member 20.

A protruding edge 14 is provided part-way up the bulb housing member 6, this being concentric with the bulb housing member 6 and having a ring shape. The protruding edge 14 seals off an upper face of the base member 5 (described below). The base member 5 allows the electric wire W to be distributed before this base member 5 is attached to the socket main body 4. It has a circular shallow plate shape, and is attached to a portion of the socket main body 4 below the protruding edge 14 of the bulb housing member 6. Electric wire pushing members 15, which correspond in number to the number of electric wires distributed within the bulb socket, protrude within a base face of the base member 5. When the base member 5 has been fitted to the socket main body 4, the electric wire pushing members 15 maintain the electric wire W, which has been pushed into the grooves 13 of the terminals 11A and 11B, in a pushed-in state. Moreover, a plurality of electric wire through-grooves 16 are provided vertically into a circumference wall of the base member 5 from an upper edge thereof. The electric wire W is first distributed within the base member 5 by being inserted through the electric wire through-grooves 16. The base member 5 is then fitted to the socket main body 4, and the electric wire W is maintained in a gripped state between a lower wall face of the bulb housing member 6 and an inner circumference face of the base member 5.

Like the bulb sockets 1 and 2 described above, the connector 3 for providing electricity to the bulbs is also configured in two parts, a terminal housing member 3A for housing the terminals 11A and 11B, and a base member 3B that is fitted to the terminal housing member 3A. However, the upper face of the terminal housing member 3A is closed, and a fitting member 3C protrudes from the base member 3B. A corresponding connector 3 (not shown) is fitted to this fitting member 3C. In addition, terminals of the connector 3 also differ from the case of the bulb sockets 1 and 2 described above, in that these terminals (which are not shown in detail) are attached within the base member 3B, one end of the terminals being provided with a contact member 19 and being housed within the terminal housing member 3A, and the other end of the terminals forming male tabs 17 protruding into the fitting member 3C.

Figure 6:
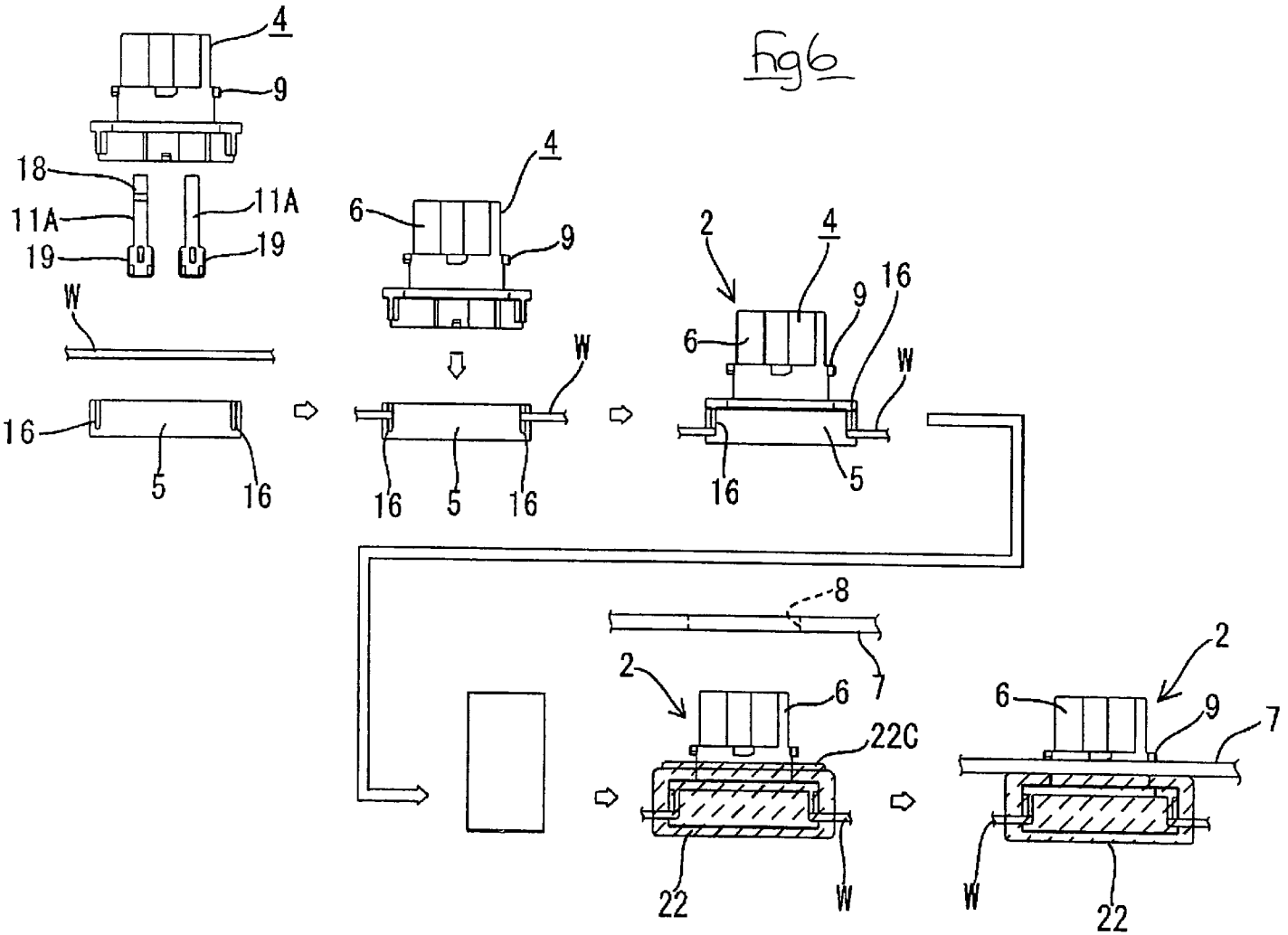
FIG. 6 is a view showing the entire operational processes whereby a lighting fixture is assembled.

Next, the attachment process of the lighting fixture will be described with reference to 25 FIG. 6. First, the terminals 1-1A (1-1B) are inserted into the bulb housing member 6 of the socket main body 4 from the base face thereof. At this juncture, the contact members 18 of the terminals 11A and 11B are located within the space for housing the bulb B, and the contact members 19 are located in the lower side of the bulb housing member 6.

Figure 2:
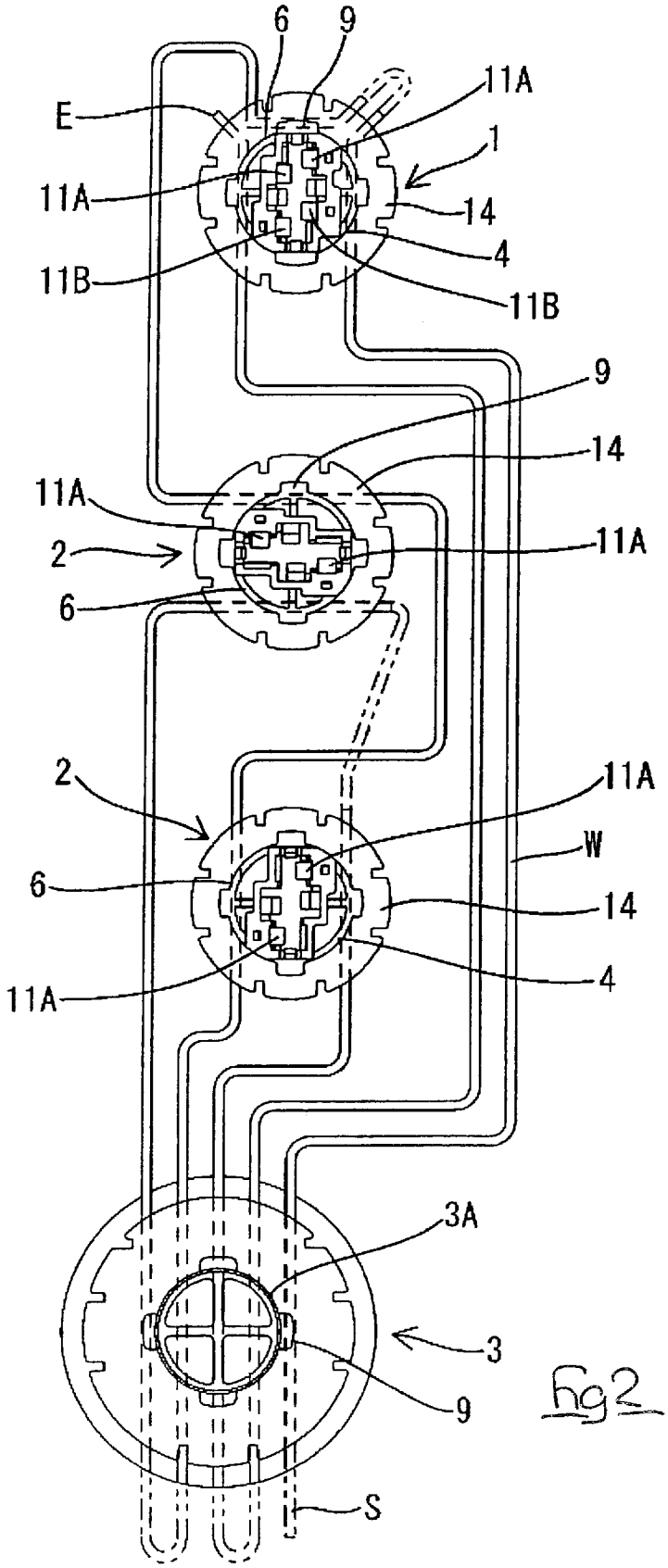
FIG. 2 is a plan view showing the wiring configuration between the bulb sockets after the sealing member has been moulded.
Figure 3:
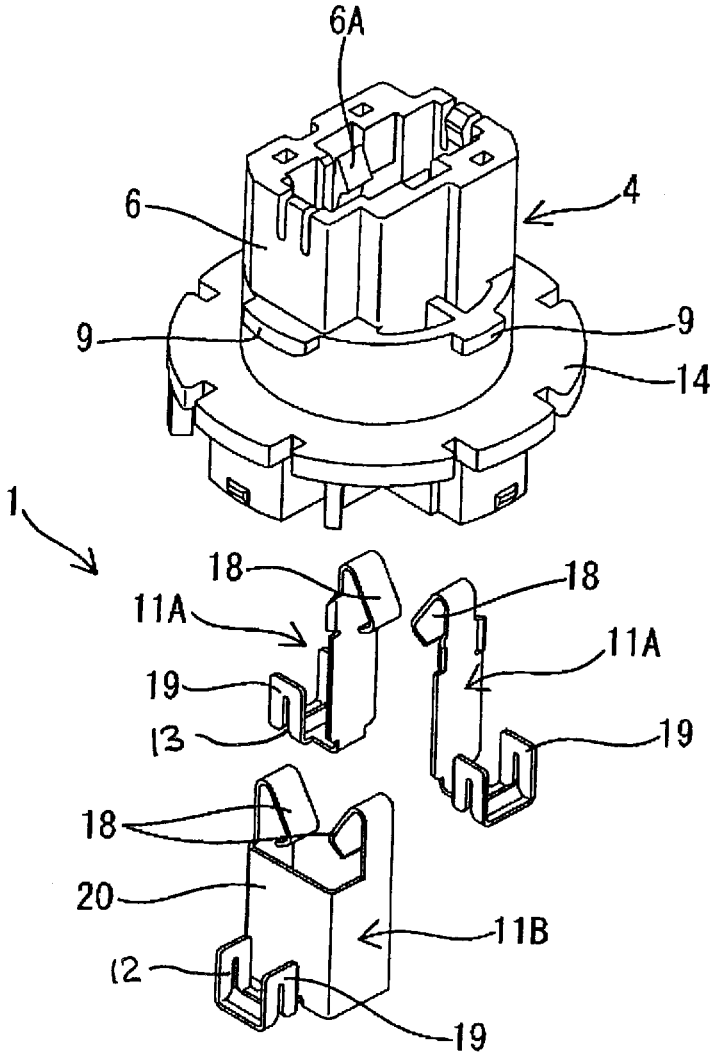
FIG. 3 is a disassembled diagonal view of a double-bulb bulb socket.
Figure 3:
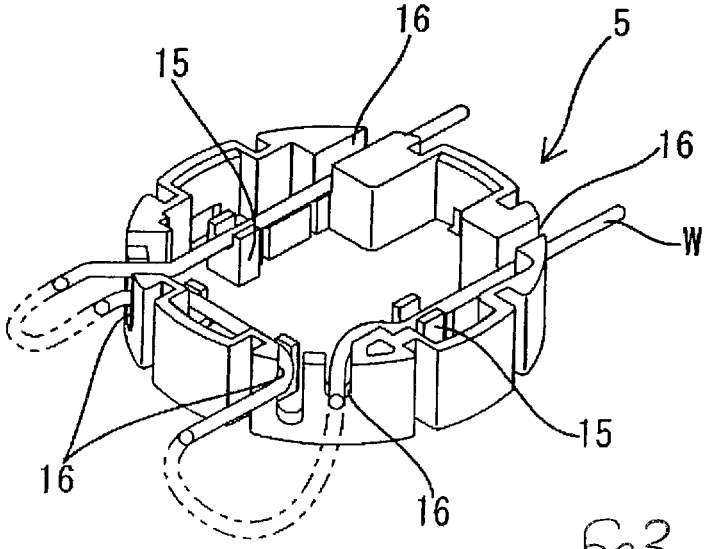

The single long electric wire W is used to distribute wiring between the connector 3 and the bulb sockets 1 and 2. This electric wire W is passed through the connector 3 and the electric wire pushing members 15 of the base member 5 of each bulb socket, and is inserted deeply into the electric wire through-grooves 16. In the present embodiment, the electric wire W is distributed as shown in FIG. 2. That is, the electric wire W begins at a specified position of the connector 3 (this position is shown by S in FIG. 2). It is then led into the double-bulb bulb socket 1, and then to the exterior thereof, forming a loop. Then, it is led back into the double-bulb bulb socket 1, and after that to the exterior thereof Next, the electric wire W is passed in turn through: both single-bulb bulb sockets 2; the interior of the connector 3; out of and into the connector 3 by a U-turn at the exterior thereof; and both single-bulb bulb sockets 2. Then the electric wire W is again passed twice through the connector 3 in the same manner as described above, led into the double-bulb bulb socket 1, and a final end of the electric wire W protrudes slightly from the double-bulb bulb socket 1 (this position is shown by E in FIG. 2).

After the wiring of the connector 3 and the bulb sockets 1 and 2 has been completed, the base member 5 is fitted to the socket main body 4, and the base member 3B is attached to the terminal housing member 3A. By this means, the electric wire W makes contact with the terminals 11A and 11B within the connector 3 and the bulb sockets 1 and 2. That is, the electric wire W is pushed by the electric wire pushing members 15 into the grooves 13 of the terminals 11A and 11B, the cover of the electric wire W is cut away as it is pushed in, and the core wires thereof make contact with the grooves 13.

Next, the portions of the distributed wiring extending to the exterior of the bulb sockets 1 and 2 and the connector 3, and shown by the broken line in FIG. 2, are cut off. That is, the portions of the electric wire W that are cut off are the wires that extend in a looped shape to the exterior of the connector 3 and the double-bulb bulb socket 1, and the single wire along the path joining the two single-bulb bulb sockets 2. The remaining wiring constitutes the feeder circuit to the bulbs B.

Figure 8:
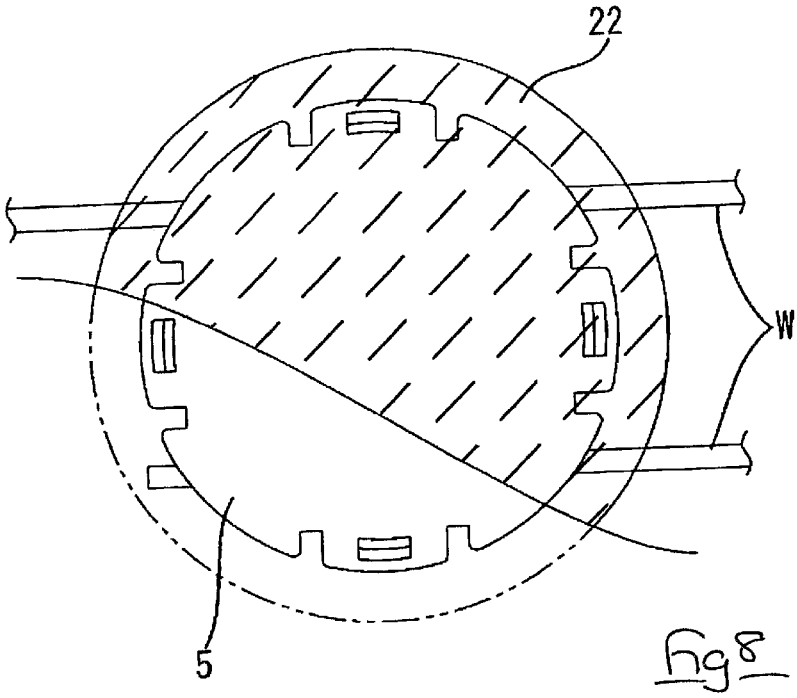
FIG. 8 is a broken view showing, from the base face thereof, the state of the single-bulb bulb socket (double-bulb bulb socket) after the sealing member has been moulded therein.
Figure 9:
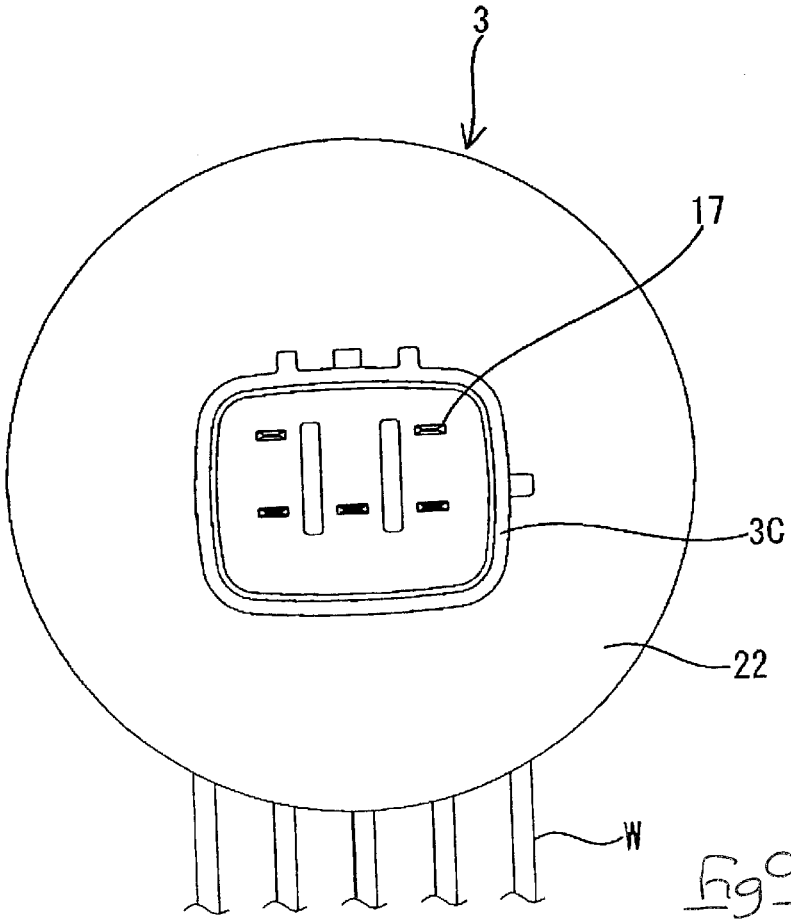
FIG. 9 is a base face view of a connector.
Figure 10:
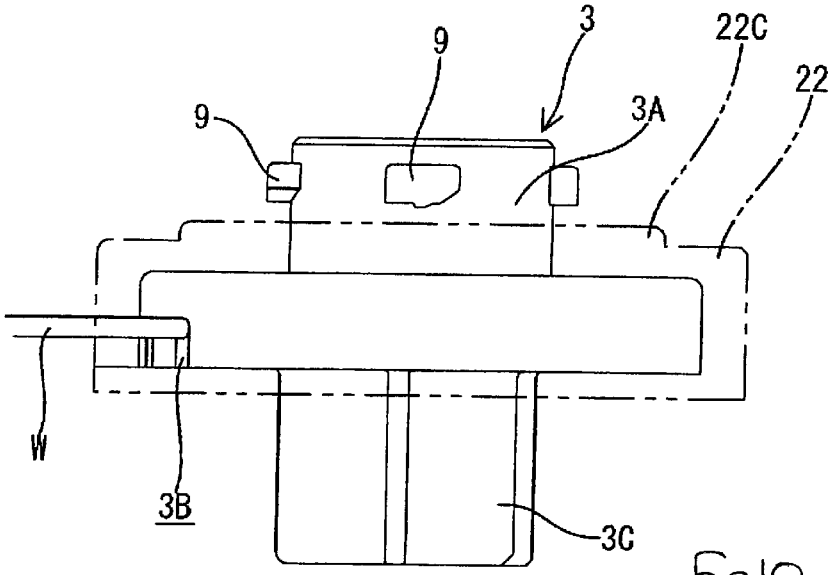
FIG. 10 is a front view of the connector.
Figure 11:
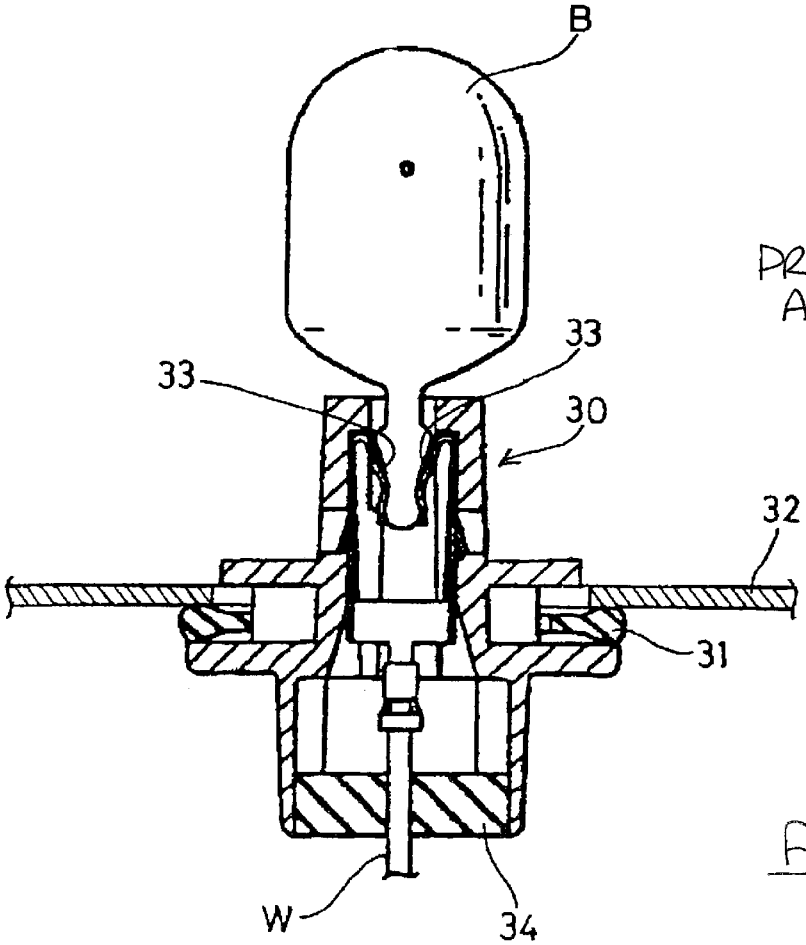
PRIOR ART Fig 11
FIG. 11 is a cross-sectional view showing a prior art sealing configuration of a bulb socket.

Next, the connector 3 and the bulb sockets, all of which have been mutually connected by the electric wire W, are attached to a sealing mould, and elastomer moulding is performed so as to cover the entire face of the base member 5. A sealing member 22 covers an entire face of the bulb sockets below the bayonet members 9; that is, it extends from an upper face of the protruding edge 14 to the portion of the socket main body 4 that fits with the base member 5, and covers the entirety of the base face of the base member 5 (the portions shown by shading in FIGS. 6, 7 and 8).

Simultaneously, the end faces of the electric wire W, which were created by cutting off the electric wire W, are covered by the sealing member 22. The only portions of the electric wire W that now extend slightly to the exterior are those which mutually join the bulb sockets 1 and 2 and which join the connector 3 with the bulb sockets 1 and 2. A sealing edge 22C, capable of being squashed against the panel 7, is located at an upper face of the sealing member 22 somewhat away from an outer circumference edge thereof. This sealing edge 22C is concentric with the sealing member 22 and has a ring shape—see also FIG. 5B.

This section describes the operation whereby the bulb sockets and the connector 3 are attached to the lighting fixture panel 7. First, an innermost edge of the bulb housing member 6 is faced towards the attachment hole 8 of the panel 7. The bayonet members 9 are then positioned so as to correspond to the recessed holes 10, and the bulb housing member 6 is pushed inwards. When the bayonet members 9 have passed through the panel 7, the entirety of the bulb socket is rotated. This causes the bayonet members 9 to engage with the hole edges of the attachment hole 8, thereby attaching the bulb sockets and the connector 3 in an unremovable manner to the panel 7. After this operation has been performed on each of the bulb sockets and on the connector 3, the assembly operation of the lighting fixture is complete.

In this attached state, a seal is formed between the panel 7 and the bulb sockets 1, 2 and the connector 3, this attaching the sealing member 22 tightly to a face of the panel 7. Further, the space between the base member 5 and the socket main body 4, and the fitting member 3C, are sealed by being covered by the sealing member 22. The end faces of the electric wire W, which were created by cutting off the electric wire W to form the feeder circuit, are also covered by the sealing member 22. Consequently, water is prevented from entering between the core wires and the cover of the electric wire W, and a sealed state can reliably be achieved.

According to the present embodiment, wiring can be distributed between the connector 3 and the bulb sockets 1 and 2 merely by performing a pressure contact operation on the terminals 11A and 11B. Subsequently the sealing member 22 is moulded, thereby sealing the portions of the electric wire W extending from the bulb sockets 1 and 2, the cut-off end faces of the electric wire W, the final end of the electric wire W, the area surrounding the attachment holes 8 of the panel 7, and the space between the socket main bodies 4 and the base members 5. As a result, the attachment operation of the lighting fixture, as well as the waterproofing thereof, can be performed easily. Consequently, these operations can also be automated.

Moreover, the wiring distribution of the present embodiment is performed using a single electric wire W. In the case where a plurality of electric wires W are used, these electric wires W have differing lengths which correspond to the differing lengths of the connecting paths. The present embodiment does not need this plurality of electric wires all. W having differing lengths. Consequently, the present embodiment allows one to avoid the difficulty of choosing the correct electric wire W, and is also advantageous from the viewpoint of parts management. Further, the electric wire through-grooves 16 are provided in the base member 5, the electric wire W being inserted therethrough. As a result, the electric wire W is easily maintained in position relative to the pressure-welding terminals 11A and 11B. Furthermore, the base of the base member 5 prevents moulding materials from entering the bulb socket when the sealing member 22 is moulded. As a result, special masking means are not required.

Furthermore, the possibilities described below also lie within the technical range of the present invention.

(1) In the present embodiment, the bulb socket is formed from two members: the socket main body 4 and the base member 5. However, the bulb socket may equally well be formed from the socket main body 4 alone. In that case, the electric wire W is joined by pressure contact to the terminals 11A and 11B, and a suitable plug is used to cover a base end face of the bulb housing member 6 when the sealing member 22 is to be moulded, this plug being covered by the sealing member 22.

(2) The wiring distribution between the connector 3 and the bulb sockets need not be performed by a single electric wire W. A plurality of electric wires W may equally well be employed.

What is claimed is:

1. A bulb socket assembly comprising a bulb socket for being secured within an opening in a panel, said bulb socket having a plurality of portions including a sidewall and a base, insulation displacement terminals, an insulated electrical wire connected to said terminals by insulation displacement, and a unitary sealing member surrounding portions of said sidewall and said base of said bulb socket so as to encapsulate and seal said portions of said sidewall, said base, portions of said insulation displacement terminals, and portions of said wire connected to said terminals against the ingress of water when said bulb socket is secured within the panel.

2. An assembly according to claim 1 wherein said bulb socket has a bayonet fitting with bayonet projections, and said sealing member is moulded on said socket so as to provide a seal against a panel in which the assembly is in use installed.

3. An assembly according to claim 2 wherein said bayonet fitting includes a stop flange to limit insertion thereof in said panel, said sealing member being moulded over said stop flange to provide a circular panel seal.

4. An assembly according to claim 1 wherein said sealing member further includes a continuous raised bead for contacting the panel.

5. An assembly according to claim 1 and including an electrical wire having a cut end adjacent one of said terminals, said sealing member encapsulating said cut end.

6. An assembly according to claim 1 wherein said bulb socket comprises a tubular bulb receiving member having an opening at one end to receive a bulb, and said terminals being exposed at the other end, and a base for engagement with said receiving member and defining a pathway for said wire.

7. An assembly according to claim 6 wherein said base comprises a plate having an upstanding peripheral wall, and said wall having open slots to define entry and exit openings for said wire.

8. An assembly according to claim 7 wherein said base includes upstanding supports for said wire, and adapted to urge said wire into said terminals on engagement of said base and receiving member.

9. A method of waterproofing a plurality of bulb socket assemblies, each bulb socket assembly comprising a bulb socket including a sidewall and a base, and an insulation displacement terminal electrically connected to a common insulated wire by insulation displacement, the method comprising the step of moulding a sealing member over a portion of said sidewall and said base of each respective socket so as to encapsulate respective terminals and portions of said wire connected to said respective terminals within said bulb socket.

10. A method of wiring a plurality of bulb sockets to an electrical connector, each socket having two insulation displacement terminals to be electrically connected to an insulated wire by insulation displacement, the method comprising the steps of providing a single length of insulated wire to connect said connector to all of said terminals, applying the insulation displacement terminals to said insulated wire, cutting away portions of said insulated wire with said insulation displacement terminals of each socket to define separate electrical connections between said connector and sockets and moulding a respective sealing member over portions of each socket so as to encapsulate portions of the respective terminals and portions of the wire connected to the respective terminals.

11. A method according to claim 10 wherein said cut ends are immediately adjacent a respective bulb socket.

12. A method according to claim 10 wherein prior to cutting, one end of said single length of wire is located at said connector, and the other end is located at one of said sockets.

13. A met hod according to claim 11 wherein prior to cutting, one end of said single length of wire is located at said connector, and the other end is located at one of said sockets.

14. An assembly according to claim 1 wherein said sidewall of said bulb socket forms a portion of a bulb socket body; and said base includes a sidewall and a terminal end face.

15. An assembly according to claim 14 wherein said bulb socket body is secured to said base member, and said sealing member covers said base sidewall and said base end face.

16. An assembly according to claim 15 wherein said bulb socket body includes a shoulder for positioning proximate the opening in the panel; and said sealing member comprises a first portion for extending over the shoulder of said bulb socket body so as to provide a seal against said panel when the bulb socket is positioned within the opening in the panel, a second portion for covering said end face of said base and a sidewall connecting said first and second portions of said sealing member so that said sealing member is a single continuous member.

17. The assembly according to claim 16 wherein said sealing member has a continuous raised bead for contact with said panel when in use.

* * * * *